United States Patent [19]

Miura

[11] Patent Number: 4,585,225

[45] Date of Patent: Apr. 29, 1986

[54] PAPER JOGGING APPARATUS

[76] Inventor: Isamu Miura, 16-6, Ryusen 3-chome, Taitou-ku Tokyo, Japan, 110

[21] Appl. No.: 642,662

[22] PCT Filed: Jun. 30, 1984

[86] PCT No.: PCT/JP84/00340

§ 371 Date: Aug. 8, 1984

§ 102(e) Date: Aug. 8, 1984

[87] PCT Pub. No.: WO85/00349

PCT Pub. Date: Jan. 31, 1985

[30] Foreign Application Priority Data

Jun. 30, 1983 [JP] Japan ..... 58-118835
Jun. 30, 1983 [JP] Japan ..... 58-118836
Jun. 30, 1983 [JP] Japan ..... 58-118837
Jun. 30, 1983 [JP] Japan ..... 58-118838

[51] Int. Cl.[4] ..... B65H 31/38

[52] U.S. Cl. ..... 271/211; 271/215; 271/217; 271/221

[58] Field of Search ..... 271/220, 221, 222, 215, 271/217, 211

[56] References Cited

U.S. PATENT DOCUMENTS 2,341,793 2/1944 Keil ..... 271/221 X
2,957,691 10/1960 Williams ..... 271/215
3,334,895 8/1967 Daniels ..... 271/215 X
3,761,080 9/1973 Larson ..... 271/222 X
4,311,090 1/1982 Dudziak ..... 271/215 X

FOREIGN PATENT DOCUMENTS 1329801 9/1973 United Kingdom ..... 271/221

*Primary Examiner*—Richard A. Schacher
*Attorney, Agent, or Firm*—Sherman & Shalloway

[57] ABSTRACT

A paper jogging apparatus can automatically jog paper sheets due to vibratory action of vibratory plate (19) disposed on an upper portion of a tiltable body (2) simply by tilting the tiltable body (2) having an up-down table (3) vertically movable by an up-down driver (8) and stacking an appropriate number of paper sheets on the up-down table (3) as tilted.

7 Claims, 12 Drawing Figures

FIG. 5
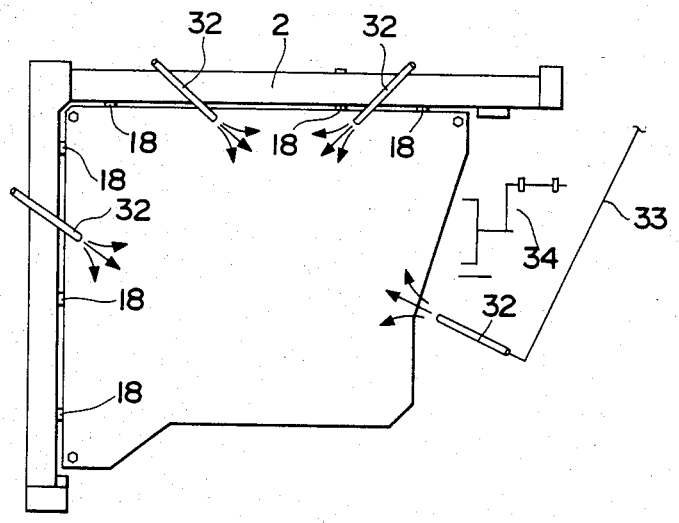
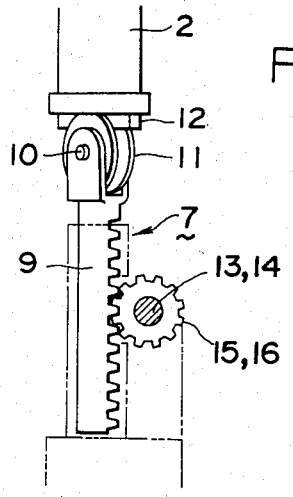
FIG. 6

PAPER JOGGING APPARATUS

FIELD OF THE ART

The present invention relates to a paper jogging apparatus for stacking a multiplicity of paper sheets while aligning corners thereof.

BACKGROUND ART

When printing paper sheets on a printing machine at a prescribed position on the paper sheets under the same conditions, it is necessary that the corners of the paper sheets be aligned. For cutting paper sheets of different sizes to the same dimentions, it is necessary to align at least two edges of the paper sheets. Heretofore, since such a paper jogging process has entirely been effected manually, the process has been quite laborious and time-consuming, and it has been rather difficult to align paper sheets uniformly.

DISCLOSURE OF THE INVENTION

It is an object of the present invention to provide a paper jogging apparatus which will eliminate the above disadvantages and can pile paper sheets while automatically and uniformly aligning corners thereof simply by successively stacking the paper sheets downwardly.

BRIEF DESCRIPTION OF THE DRAWINGS

FIG. 5 is a schematic plan view;

FIG. 6 is a schematic view of a lifter;

BEST MODE FOR CARRYING OUT THE INVENTION

Figure 1:
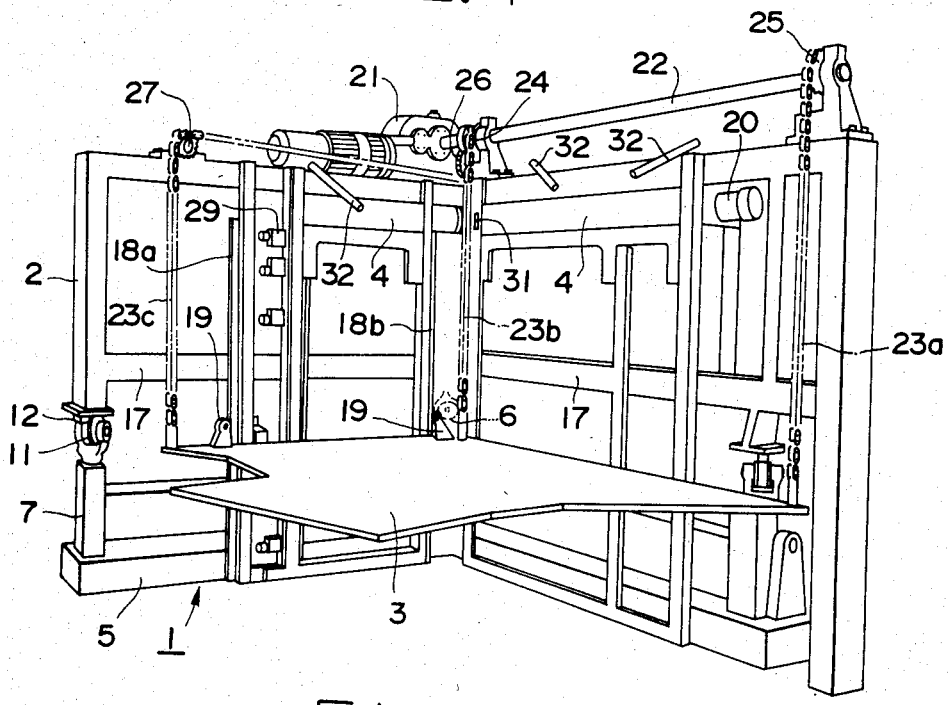
FIGS. 1 and 2 are perspective views showing the manner in which a paper jogging apparatus is in use.

Embodiments of the present invention will hereinafter be described with reference to the drawings.

As shown in FIGS. 1 through 4, a paper stacking and jogging apparatus according to the present invention comprises a base frame body 1, a tiltable body 2 supported on the base frame body 1 and tiltable with respect thereto, an up-down table 3 vertically movably attached to the tiltable body 2, and vibratory plates 4 mounted on an upper portion of the tiltable body 2 for jogging paper sheets.

As illustrated in FIGS. 1 through 5, the base frame body 1 has main frames 5 extending symmetrically horizontally at a prescribed angle and placed on a ground A or the like, a support post 6 extending upwardly at the center of the horizontally extending main frames 5 and supporting the tiltable body 2 in a tiltable manner, lifters 7 vertically movable on distal ends of the main frames 5 for lifting the opposite ends of the tiltable body 2 to tilt the same about the support post 6, and a tilting motor 8 for vertically moving the lifter 7.

Figure 3:
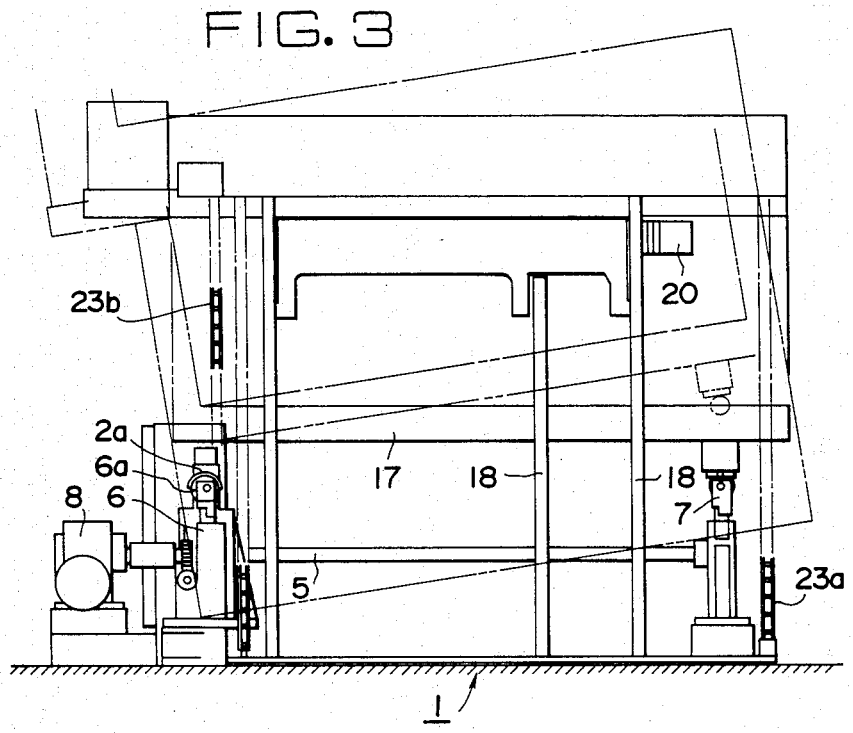
FIG. 3 is a lefthand side elevational view of the paper jogging apparatus.
Figure 4:
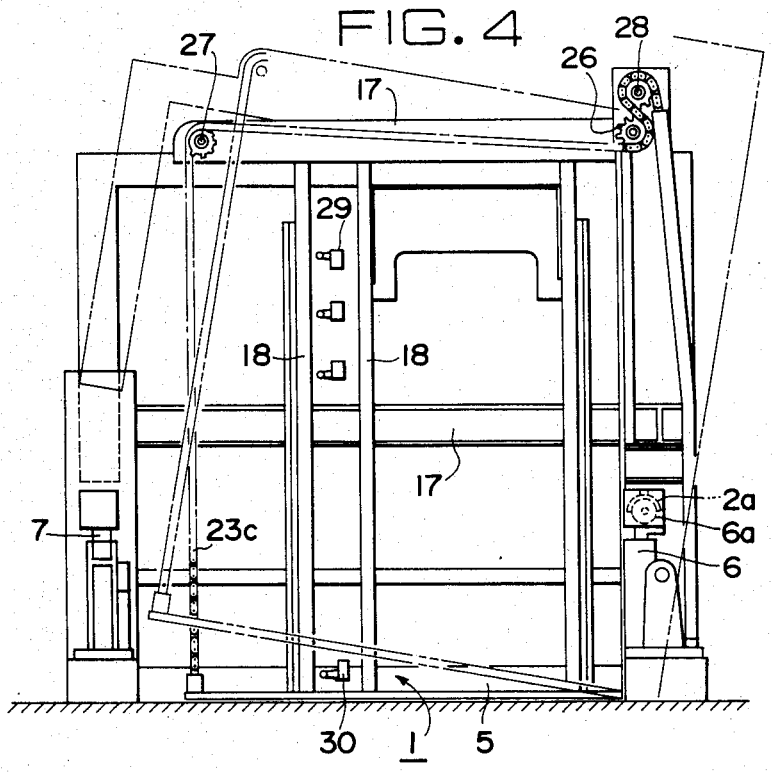
FIG. 4 is a righthand side elevational view of the paper jogging apparatus.

The tiltable body 2 is tiltably supported on the support post 6 by means, for example, of a ball **6*a* mounted on the upper end of the support post 6, and a spherical bearing 2*a* mounted on the tiltable body 2 and holding the ball 6*a* therein, the tiltable body 2 being tilted when the spherical bearing 2*a* is tilted over the surface of the ball 6*a*. As shown in FIGS. 3 and 4, the tiltable body 2 is tiltably supported on the support post 6 in the vicinity of a substantially central portion of the tiltable body 2**.

As shown in FIGS. 1 though 4 and FIG. 6, each lifter 7 is composed of a vertically movable rack 9 and a grooved roller 11 angularly movably mounted by a pin 10 on an upper end of the rack 9. The roller 11 is movably held in engagement with a ridge 12 mounted on each of ends of vertial frames of the tiltable body 2. The racks 9 are disposed parallel to the main frames 5 and held in mesh with gears 15, 16 mounted on distal ends of shafts 13, 14 rotatable by the tilting motor 8.

As shown in FIGS. 2 through 5, the tiltable body 2 comprises horizontal frames 17 extending parallel to the main frames 5, and a plurality of vertical frames 18 extending perpendicularly to the horizontal frames 17. Opposite ones **18*a*, 18*b* of the vertical frames 18 have the ridges 12 engaging the rollers 11 of the lifters 7. Some of the vertical frames 18 have such as hexagonal posts 18*a*, 18*b* engaging guide rollers 19 on the up-down table 3 so that the up-down table 3** can reliably guided even when a large stack of paper sheets is placed thereon.

Vibratory plates (in this embodiment, a pair of vibratory plates for aligning the opposite sides of a corner of paper sheets) 19 are mounted on an upper portion of the tiltable body 2. Each vibratory plate 4 can be vibrated in response to rotation of an eccentric roller (not shown) held against the back of the vibratory plate and rotated by a vibration motor 20. The vibratory plate 19 as it vibrates successively knocks on side edges of paper sheets P piled on the up-down table 3 for uniformly aligning the sides of the paper sheets P.

A motor 21 is mounted on an upper edge of the tiltable body 2 for lifting and lowering the up-down table 3. The motor 21 has a rotatable shaft 22 extending along one of the horizontal frames 17 of the tiltable body 2 and having gears 24, 25 held in direct mesh with chains **23*a*, 23*b* and a gear 28 meshing with a chain 23*c* trained over gears 26, 27 rotatably supported on the other horizontal frame 17**.

Upper and lower limit switches 29, 30 are mounted on one of the vertical frames 18 of the tiltable body 2 and positioned in a vertical path of a projection **3*a* on the up-down table 3. When the projection 3*a* on the up-down table 3 hits the switch 29 or 30, a power supply circuit for the motor 21 is opened to stop the up-down table 3 at an upper limit or lower limit position. A microswitch 31 for paper jogging is mounted upwardly of a path of upward movement of the up-down table 3. When the paper sheets P stacked on the up-down table 3 hit the switch 31, the motor 21 is rotated in one direction to a prescribed extent for lowering the up-down table 3 a prescribed interval. Therefore, the up-down table 3 is lowered the prescribed interval each time paper sheets P are piled on the up-down table 3**, and such downward movement of the table is repeated until the lower limit is reached.

An air blower pipe 33 is diposed above the tiltable body 2 and has air blower nozzles 32 directed toward the up-down table 3. Air ejected from the air blower nozzles 32 enters between the paper sheets P stacked on the up-down table 3 to prevent the paper sheets P from sticking to each other due to static electricity, thus allowing the vibrator plates 19 to jog the paper sheets smoothly.

To the up-down table 3 are fixed the chains 23*a*–23*c* to keep the up-down table 3 horizontally (through three points in the embodiment). The up-down table 3 can be lifted and lowered by moving the chains 23*a*–23*c* up and down with the motor 21. For reliably raising and lowering the up-down table 3, sides thereof are held against the vertical frames 18, and has guide rollers 19 having grooves engaging the hexagonal posts 18.

Figure 7:
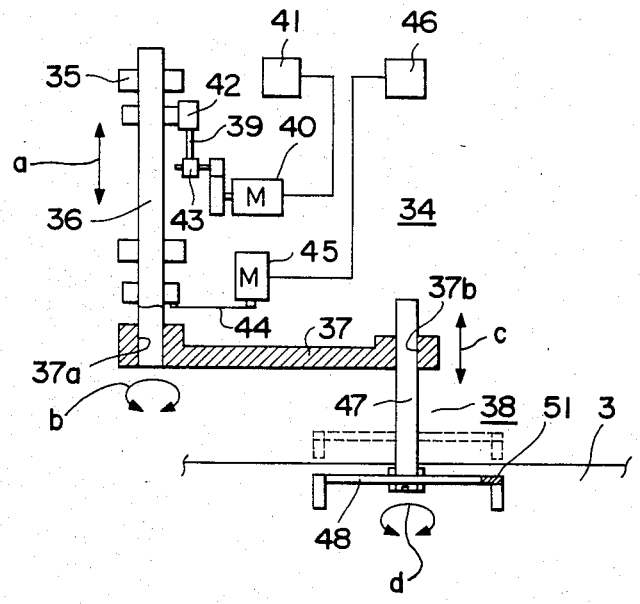
FIG. 7 is a schematic view of a paper holder.

A paper holder 34 is disposed in the vicinity of the up-down table 3 which serves as a paper supply section. As shown in FIG. 7, the paper holder 34 has a first support shaft 36 supported on supports 35 for slidable movement in the direction of the arrow (a) and angular movement in the direction of the arrow (b), a second support shaft 37 fixed to an end of the first support shaft 36, and an arm 38 having one end supported on the second support shaft 37.

The first support shaft 36 is coupled through a crank mechanism 39 to a first motor 40. As illustrated in FIG. 7, the first motor 40 is connected to a sensor 41 disposed in the vicinity of a supply section of the paper holder 34. The first support shaft 36 is slidably moved toward the up-down table 3 in the direction of the arrow (a) by the first motor 40 energized by a paper supply signal sensed by the sensor 41. A junction 42 between the crank mechanism 39 and the first support shaft 36 and a junction 43 bewteen the crank mechanism 39 and the first motor 40 are connected by spherical bearings (not shown). The first support shaft 36 is coupled to a second motor 45 through a mechanism 44 having a spherical bearing in the form of an ordinal rod end or the like and is angularly movable in the direction of the arrow (b) by the second motor 45. The second motor 45 is connected to a timer 46 which operates a prescribed time after the first motor 40 has been energized. The second support shaft 37 is fixed to the first support shaft 37 through a hole 37*a* is turned in the direction of the arrow (b) in response to turning movement of the first support shaft 36. The first support shaft 36 has an adjustment screw (not shown) attached thereto. By adjusting the extent of projection of the adjustment screw, the range in which the second support shaft 37 is angularly movable in the direction of the arrow (b) can be adjusted.

The second support shaft 37 has an insertion hole 37*b* in one end thereof with the arm 38 extending therethrough which holds paper sheets supplied to the paper jogging apparatus. The arm 38 extends through the insertion hole 37*b* and has an arm shaft 47 positionally adjustable in the direction of the arrow (c) and a holder finger 48 supported on a free end of the arm shaft 47 for swinging movement in the direction of the arrow (d).

Figure 8:
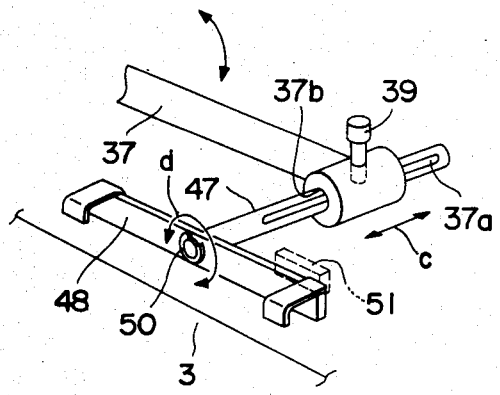
FIG. 8 is a perspective view of an arm.

As illustrated in FIG. 8, the arm shaft 47 is affixed to the second shaft 37 by means of a setscrew 39 extending into the insertion hole 37*b*. By adjusting the position in which the setscrew 39 engages in a key slot 47*a*, the arm shaft 47 can be positionally adjusted in the direction of the arrow (c) dependent on the size of a paper sheet to be held.

Figure 9:
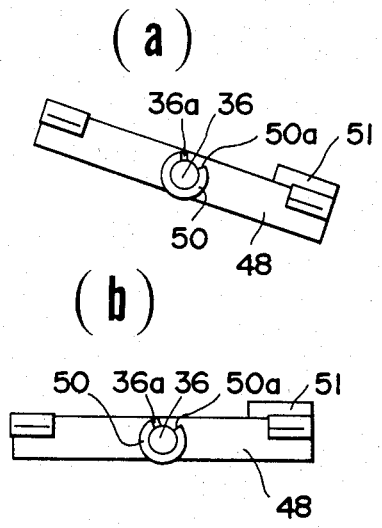
FIG. 9 is a set of plan views of an arm.

The arm shaft 47 has a free end extending through a substantially central hole (not shown) in the holder finger 48 to allow the holder finger 48 to be loosely mounted on the arm shaft for angular movement in the direction of the arrow (d). The free end of the arm shaft 47 has a projection 36*a* engaging a recessed plate 50 fixed to the holder finger 38 for permitting the latter to swing in the direction of the arrow (d) in a prescribed angular range. The range in which the holder finger 38 is angularly movable is limited to the prescribed angular range by an angle of a recess 50*a* in the recessed plate 50. A weight 51 secured to one end of the holder finger 48. Under normal condition, the holder finger 48 is tilted as shown in FIG. 9(*a*). When the arm shaft 47 is turned, the holder finger 48 is brought to a horizontal position as shown in FIG. 9(*b*).

Operation of the paper jogging apparatus of the invention will be described.

Figure 2:
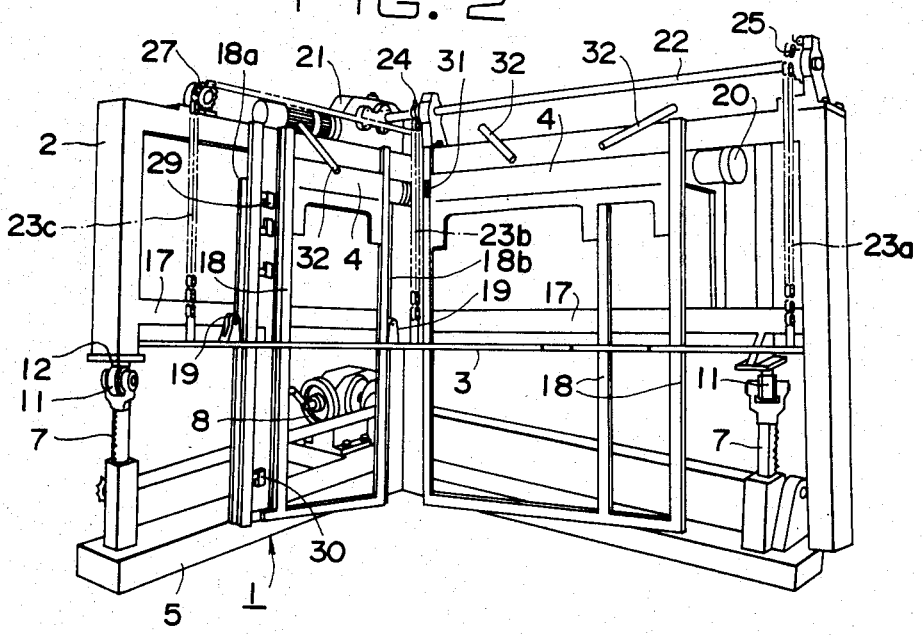

For stacking paper sheets, the tilting motor 8 is energized to lift the lifters 7 to tilt the tiltable body 2 about the post 6 as shown in FIGS. 2 through 4. Since the post 6 effects such tilting movement at a prescribed height in the vicinity of a substantially central position of the tiltable body 2, the width in which the tiltable body 2 is moved upon being tilted can be held to a minimum, so that the tiltable body 2 operates reliably and smoothly. In particular, the distance of movement of the ridges 12 held against the rollers 11 on the lifters 7 is held to a minimum, so that the tiltable body can be tilted smoothly while in reliable engagement with the rollers 11.

Then, the motor 21 is energized to wind up the chains 23*a*–23*c* to move the up-down table 3 upwardly until the upper limit switch 29 is actuated. At this time, the up-down table 3 smoothly and uniformly ascends by means of the guide rollers 19 and the vertical frames 18 held against the up-down table 3. As a consequence, a portion of the up-down table 3 which will align corners of paper sheet P is disposed in a tilted lowermost position as shown in FIGS. 2 through 4.

Piles of paper sheets P are thereafter successively stacked on the up-down table 3. Since the microswitch 31 is depressed by the paper sheets P each time one pile is placed, the up-down table 3 is lowered to allow corners of the paper sheets P to be held against the vibratory plates 19 in an optimum condition so that the paper corners will automatically be aligned quite effectively.

When the paper sheets are supplied onto the up-down table 3 so as to be stacked thereon, the sensor 41 detects the paper sheets to actuate the motor 40 to move the first support shaft 36 toward the up-down table 3 in the direction of the arrow (a). The second motor 45 is energized by the timer 40 to turn the second arm 37 and the arm 38 clockwise in the direction of the arrow (b), thus reliably holding the supplied paper sheets with the holder finger 48. Because the holder finger 48 is angularly movably supported with respect to the second support shaft 37, and the balancer weight 51 is mounted on one end of the holder finger 48, the paper sheets can be held down highly softly. The first and second motors 40, 45 for moving the first support shafts 36 are joined by the spherical bearings, as mentioned above, with the result that the operation is smooth and reliable even if the parts and operation accuracies are slightly poor. Where the paper jogging apparatus has the air blower nozzles 32 as shown in FIG. 5, air is admitted between paper sheets held down to prevent them from electrostatially sticking to each other when they are held by the holder finger 48.

Thereafter, the second motor 45 is energized by the timer 46, and then the first motor 40 is energized by another timer 46 to return the components to the original position.

While in the embodiment the first and second motors 40, 45 are operated by the sensor, timer or the like, the invention is not limited to such an arrangement, but they may be operated by a manually-operated mechanical means.

The foregoing operation is repeated until the projection 3*a* on the up-down table 3 hits the lower limit switch 30. When the up-down table 3 reaches the lower limit, it is stopped, and the stacking of the paper sheets P is now completed.

When the above operation is over, the tilting motor 8 is energized again to lower the lifters 7 to move the tiltable body 2 back to the horizontal position, and the stacked paper sheets P per pallet will be removed by a fork lift (not shown), for example, in front of the paper jogging apparatus. The entire operation is now brought to an end.

Where there are only few paper sheets P to be jogged in the above operation, the tilting motor 8 and the motor 21 may be simultaneously be actuated even before the up-down table 3 reaches the lower limit switch 30, thus returning the up-down table 3 and the tiltable body 2 to the fork lift loading position.

In actual use, decorative panels (not shown) are disposed between the vertical and horizontal frames 17, 18 of the tiltable body 2 and on the base frame 1 for preventing the paper sheet P from being damaged and entering into the apparatus.

Figure 10:
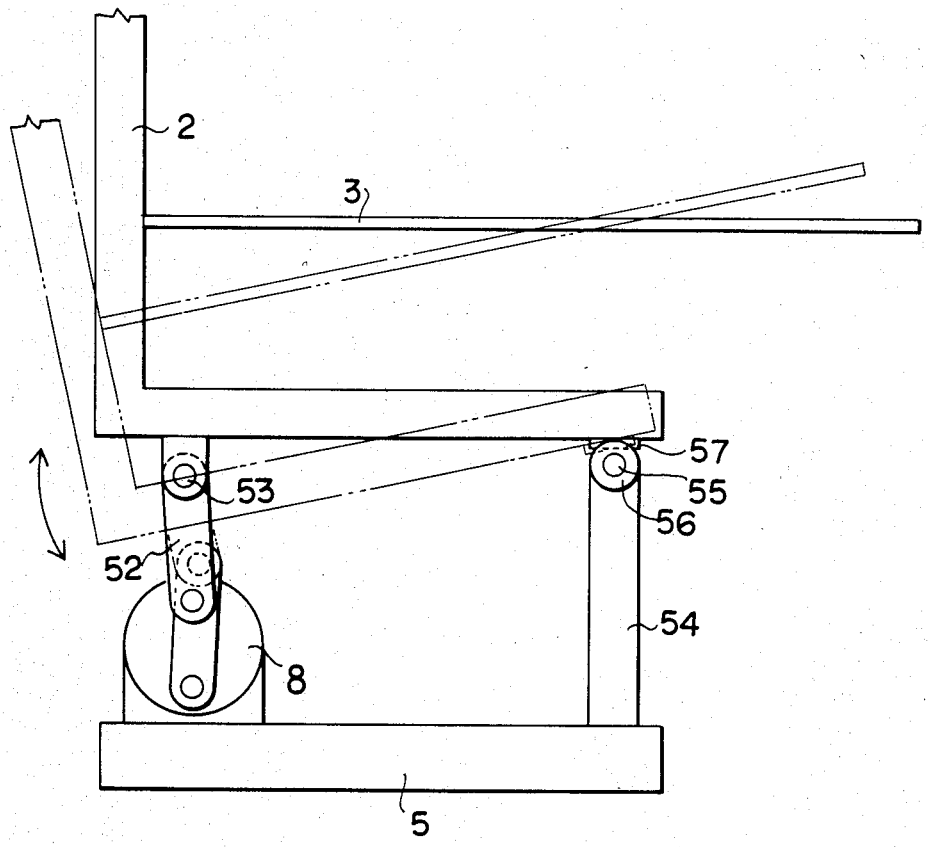
FIG. 10 is a schematic view of another embodiment of a tiltable body.

FIG. 10 shows another embodiment in which the tilting construction for the tiltable body 2 is modified. In the embodiment of FIGS. 1 through 4, the tiltable body 2 is tilted about the support post 6 by vertically moving the lifters 7 with the tilting motor 8. In the embodiment of FIG. 10, however, the support post 6 comprises a crank shaft 52 having one end coupled to the tilting motor 8 and an opposite end to a frame of the tiltable body 2 through a pin 53. A member corresponding to the lifter 7 comprises a fixed post 54 having a grooved roller 56 rotatably mounted by a pin 55 to an upper end of the fixed post 54, as with the previous embodiment, the roller 56 movably engaging a ridge 57 mounted on each of the opposite ends of the frame of the tiltable body 2.

According to the embodiment of FIG. 10, where paper sheets are to be stacked, the tiltable body is tilted as shown by the imaginary lines in FIG. 10 reliably through a simplified construction.

FIG. 10 schematically shows the tiltable body 2 only, and the other construction is the same as that shown in FIGS. 2 through 4.

Figure 11:
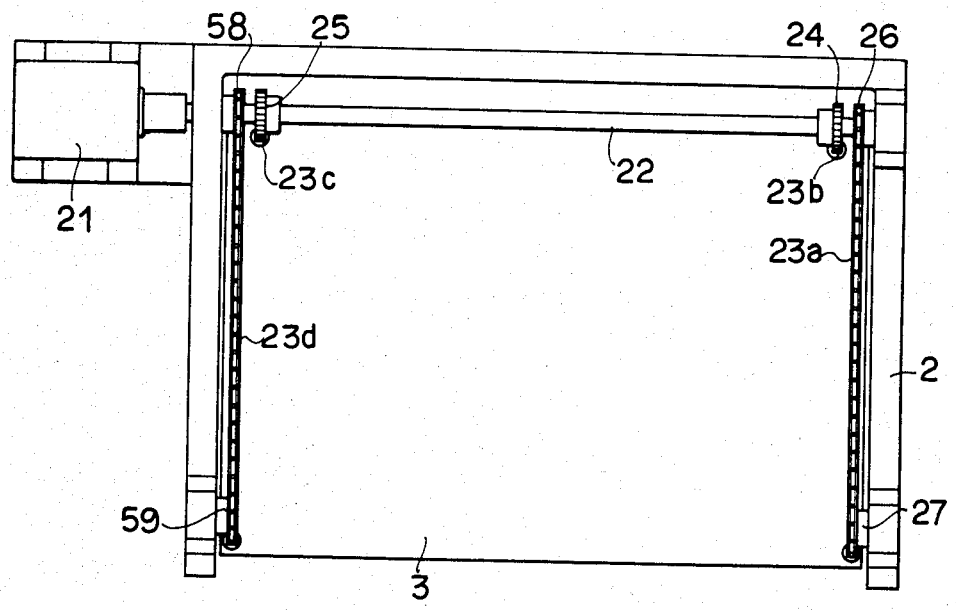
FIG. 11 is a plan view of another embodiment of a means for lifting and lowering an up-down table.
Figure 12:
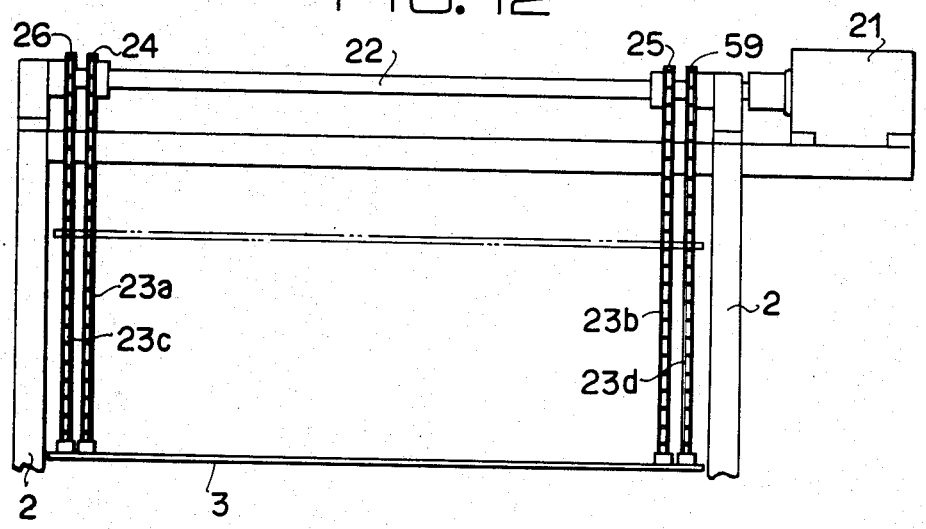
FIG. 12 is a front elevational view of the lifting and lowering means.

FIGS. 11 and 12 are illustrative of a modified construction for lifting and lowering the up-down table 3.

While in the embodiment of FIGS. 1 through 4 the up-down table 3 is supported at three points by the three chains 23*a*–23*c*, the up-down table 3 of the embodiment of FIGS. 11 and 12 is supported at four points by four chains. More specifically, the tiltable body 2 has a C-shaped frame as shown in FIG. 11, and the up-down table is moved vertically by the rotatable shaft 22 of the motor 21 through three drive chains 23*a*–23*c* and an additional drive shaft 23*d* trained over gears 58, 59. With this embodiment, the up-down table 3 can more reliably be held horizontally and can smoothly be moved up and down.

INDUSTRIAL APPLICABILITY

According to the paper jogging apparatus of the present invention, as described above, paper sheets can automaticaly be stacked due to vibratory action of the vibratory plates simply by piling an appropriate number of paper sheets on the up-down table as tilted. The efficiency of the apparatus is much better than that of manual operation, and the apparatus allows anyone to jog paper sheets accurately.

I claim:

1. A paper jogging apparatus comprising:

(a) a base frame body having horizontally extending main frames;

(b) a tiltable body tiltably supported on a support post of said base frame body and a side support portion having frame portions extending along said base frame body;

(c) tilting motor means operatively connected to said support post for raising or lowering said support post and side support portion and for tiltably moving said tiltable body about said support post for aligning said paper being stacked on said apparatus;

(d) up-down table means for carrying paper sheets and being vertically movably mounted on said tiltable body at a position surrounded by said frame portions of said tiltable body, and adapted to be raised or lowered by an up-down motor, and;

(e) vibratory plates mounted above and adjacent said tiltable body, and adapted to vibrate adjoining edges of said paper sheets on said up-down table while said up-down table is tilted by said tilting motor means so as to align the paper sheets.

2. A paper jogging apparatus according to claim 1, further comprising a paper holder disposed adjacent said up-down table and holding paper sheets applied to said up-down table by means of an arm swingably supported on support shafts advancing and retreating to and from said up-down table.

3. A paper jogging apparatus according to claim 2, wherein said paper holder comprises a first support shaft movable back and forth and angularly by first and second motors in directions toward and away from said up-down table, a second support shaft supported on one end of said first support shaft, and said arm being swingably supported on a free end of said second support shaft for holding paper sheets supplied onto said up-down table.

4. A paper jogging apparatus according to claim 1, wherein said tiltable body is tiltably supported by said support post at a prescribed height for minimizing movement of said tiltable body.

5. A paper jogging apparatus according to claim 1, wherein said up-down motor is connected to a microswitch actuation of which causes said up-down motor to lower said up-down table a prescribed interval in response to contact of said microswitch with paper sheets placed on said up-down table.

6. A paper jogging apparatus according to claim 1, including upper and lower limit switches disposed in a path of vertical movement of said up-down table and connected to said up-down motor for limiting a range of vertical movement of said up-down table.

7. A paper jogging apparatus according to claim 1, including air blower nozzle means for applying ejected air against paper sheets placed on said up-down table.

* * * * *